United States Patent [19]

Ganz

[11] 4,433,807

[45] Feb. 28, 1984

[54] CARTON CLOSURE INTERLOCK

[75] Inventor: Robert H. Ganz, Saddle River, N.J.

[73] Assignee: Federal Paper Board Co., Inc., Montvale, N.J.

[21] Appl. No.: 370,558

[22] Filed: Apr. 21, 1982

[51] Int. Cl.[3] ..... B65D 5/10

[52] U.S. Cl. ..... 229/40; 206/139; 206/140; 229/38; 229/39 R; 229/44 R; 229/45 R

[58] Field of Search ..... 229/45 R, 38, 39 R, 229/40, 44 R, 48 R, 37 R, 29 R; 53/48; 206/140, 139, 427–434

[56] References Cited

U.S. PATENT DOCUMENTS

| | | | |
|---|---|---|---|
| 3,098,583 | 7/1963 | Sherman et al. | 206/140 |
| 3,220,155 | 11/1965 | Sherman | 53/48 |
| 3,270,914 | 9/1966 | Graser | 206/140 |
| 3,655,117 | 4/1972 | Weiss | 229/40 |
| 3,705,681 | 12/1972 | Rossi et al. | 229/40 |
| 4,200,220 | 4/1980 | Ganz | 229/40 |

*Primary Examiner*—William Price
*Assistant Examiner*—Bryon Gehman
*Attorney, Agent, or Firm*—Charles E. Brown

[57] ABSTRACT

This relates to a closure interlock between closure panels of a carton of the wrap around type. The closure interlock provides for a primary locking tab on an outer one of the closure panels and a secondary locking tab on the inner one of the closure panels whereby a primary lock and a secondary lock may be formed generally in alignment longitudinally of the closure interlock thus providing for a savings of carton forming stock corresponding to the normal spacing of the primary lock and the secondary lock transversely of the general line of the closure interlock.

13 Claims, 7 Drawing Figures

CARTON CLOSURE INTERLOCK

This invention relates in general to new and useful improvements in cartons of the wrap around type having a closure panel assembly defined by inner and outer closure panels, and more particularly to the closure interlock between the inner and outer closure panels.

For many years there has been in commercial use a closure interlock wherein the outer closure panel is provided with primary and secondary locking tabs which are engaged in sequence with primary and secondary locking shoulders formed on the inner closure panel. With this arrangement, the resultant primary lock and secondary lock are spaced from one another along the length of the closure interlock, thus requiring a greater than necessary overlap of the inner and outer closure panels.

In accordance with this invention, it is proposed to modify the closure interlock by placing the primary locking tab on the outer closure panel, in the customary manner, but so forming the inner closure panel so as to have the secondary locking tab formed thereon and carried by a flap which moves out of the plane of the inner closure panel so as to define primary locking shoulders on opposite sides of the position of the secondary locking tab for engagement by the primary locking tab. Thus the primary lock and secondary lock are placed substantially in alignment along the length of the closure interlock. This permits a savings of between one half inch and three quarter inch of the carton forming material, which savings is on the order of six percent or greater depending on the size of the items which are to be wrapped into a package using the carton.

With the above and other objects in view that will hereinafter appear, the nature of the invention will be more clearly understood by reference to the following detailed description, the appended claims, and the several views illustrated in the accompanying drawing.

Figure 7:
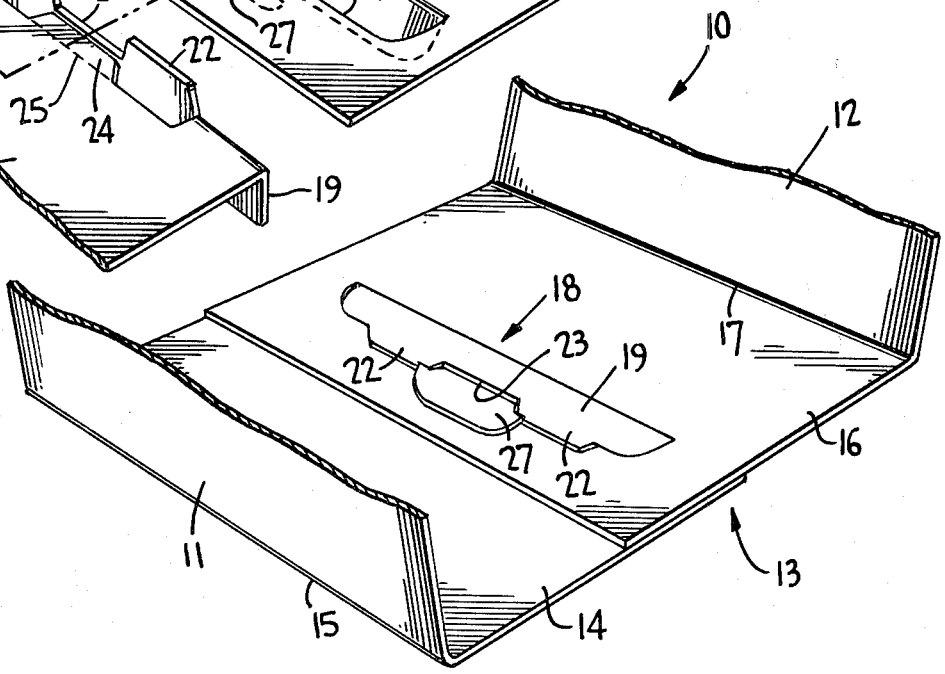
FIG. 7 is a perspective view of the lower portion of the closed carton and shows generally the details of the closure interlock.

Referring to the drawings in detail, it will be seen that there is illustrated in FIG. 7 the lower portion of a carton having a closure interlock in accordance with this invention, the carton being identified by the numeral 10. The carton 10 includes a pair of side panels 11 and 12 which are connected together by a two piece closure panel assembly generally identified by the numeral 13. The closure panel assembly 13 includes an outer closure panel 14 connected to the lower edge of the side panel 11 along a fold line 15. The closure panel assembly 13 also includes an inner closure panel 16 connected to the lower edge of the side panel 12 along a fold line 17. The closure panels 14 and 16 are interconnected by a closure interlock formed in accordance with this invention and generally identified by the numeral 18.

At this time it is pointed out that while the closure interlock 18 has universal application, it is particularly adapted for forming an interlock between closure panels of a carton intended to wrap four items with the closure interlock 18 being centered between these four items.

Figure 1:
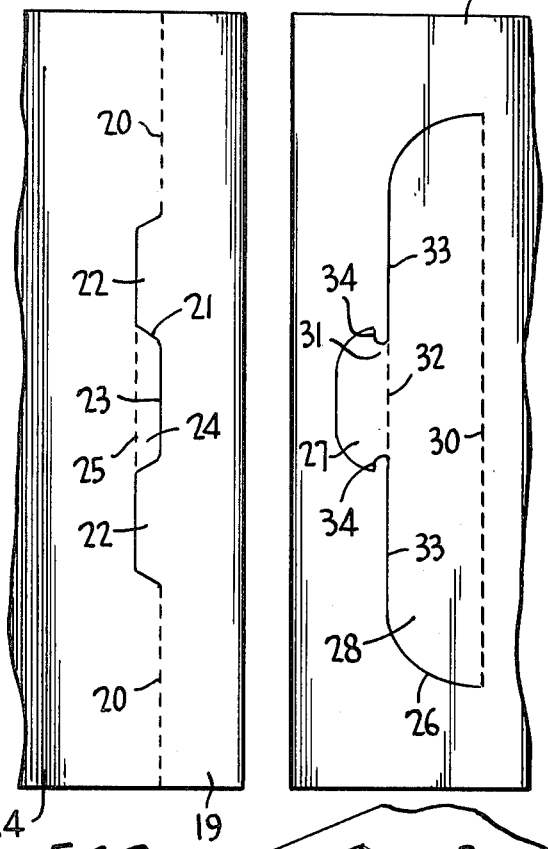
FIG. 1 is a bottom plan view of adjacent portions only of the inner and outer closure panels and shows the closure panels in spaced relation.
Figure 3:
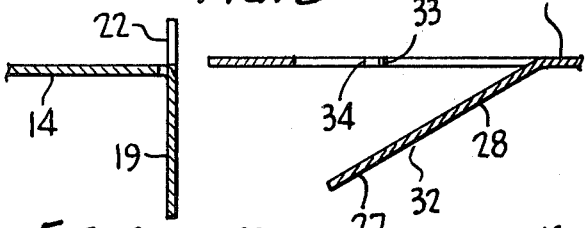
FIG. 3 is an enlarged fragmentary sectional view taken generally along the line 3—3 of FIG. 2 and shows further the details of the folded closure panel portions.

Referring now to FIG. 1, it will be seen that the closure panel 14 has formed along the free edge thereof a terminal flap portion 19 which is defined in part by an interrupted fold line 20 and a cut line 21. The combination of the fold line 20 and the cut line 21 defines a pair of primary locking tabs 22 which are spaced along the length of the closure and which are separated by a secondary locking shoulder 23. These are best seen in FIG. 2 wherein the terminal flap portion 19 is folded out of the plane of the panel 14 so that the primary locking tabs 22 are upstanding.

It is also to be noted that opposing the secondary locking shoulder 23 and between the primary locking tabs 22 is a further tab 24 which is connected to the closure panel 14 along a fold line 25. The purpose of the folding of the tab 24 will be described hereinafter.

The closure panel 16 has formed therein a cut line 26 which generally defines a secondary locking tab 27 which is carried by a secondary flap 28. The secondary flap 28 is connected to the closure panel 16 along a fold line 30. It is to be noted that the secondary locking tab 27 is connected to the flap 28 by a reduced width neck portion 31 and generally along a fold line 32.

Figure 2:
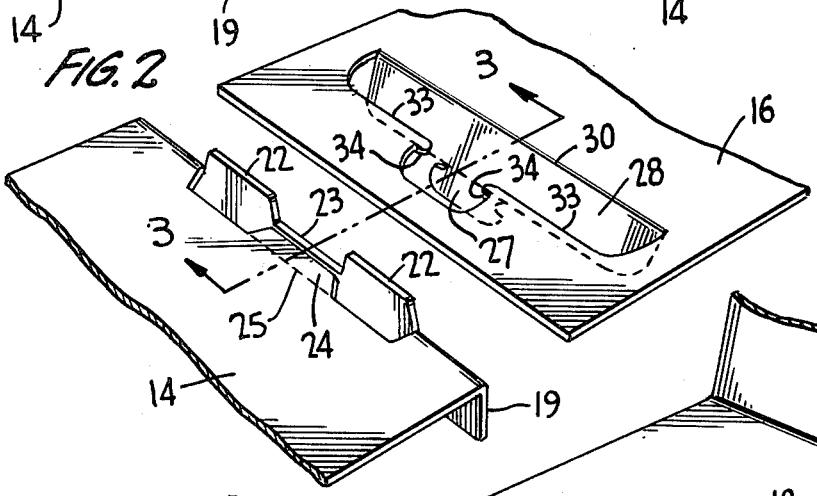
FIG. 2 is a fragmentary exploded perspective view showing adjacent edge portions only of the closure panels of FIG. 1 folded ready for interlocking engagement.

Referring now particularly to FIG. 2, it will be seen that when the secondary locking tab 27 and its associated flap 28 are struck from the panel 16, there is defined on the panel 16 a pair of primary locking shoulders 33, one on each side of the position of the secondary locking tab 27. The outline of the neck portion 31 is such that there is also formed on the closure panel 16 separate from the secondary locking tab and facing in the opposite direction from the primary locking shoulders 33 at least one and preferably two secondary locking shoulders 34.

Figure 4:
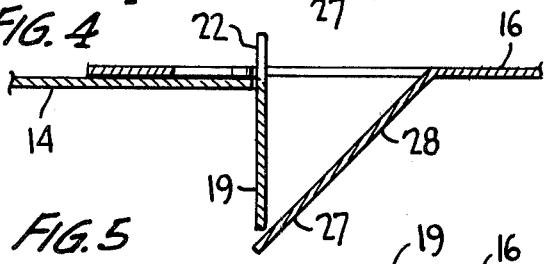
FIG. 4 is a sectional view similar to FIG. 3 but wherein the closure panels have been brought into overlapping engagement and the primary locking tab has been engaged behind its associated primary locking shoulder and serving to draw the closure panels into tight overlapping relation.
Figure 5:
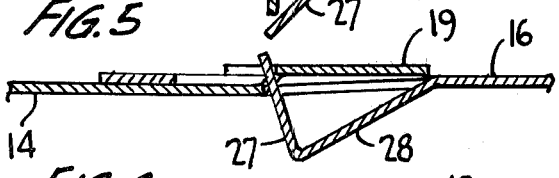
FIG. 5 is another sectional view similar to FIG. 3 showing the primary locking tab fully engaged and the secondary locking tab being moved through both the outer closure panel and the inner closure panel for engagement behind the secondary locking shoulder.
Figure 6:
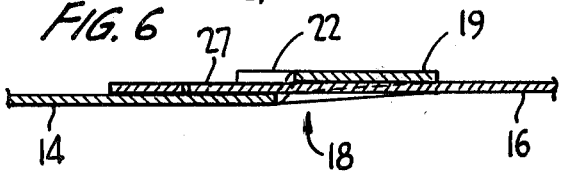
FIG. 6 is another sectional view similar to FIG. 3 showing the details of the completed closure interlock.

In the formation of the closure interlock 18, the terminal flap portion 19 and the secondary locking tab and flap 28 are folded to the positions shown in FIG. 2 prior to the overlapping of the closure panels 14 and 16. The adjacent edge portions of the closure panels 14 and 16 are then brought into overlapping relation with the primary locking tabs 22 extending through the opening and the closure panel 16 defined by the displacement of the secondary locking tab 27 and the locking flap 28 and are engaged behind the primary locking shoulders 33, as is shown in FIG. 4. The primary locking tabs 22 thus interlocked behind the shoulders 33, the terminal flap portion 19 is folded up generally through the opening in the inner closure panel 16 to the position illustrated in FIG. 5 and the secondary locking tab 27 is folded or hinged relative to the flap 28 and inserted through the openings formed in the closure panels 14 and 16 with the secondary locking tab 27 first engaging behind the secondary locking shoulder 23 and then behind the secondary locking shoulders 34, as is shown in FIG. 5.

Further movement of the secondary locking tab 27 and the associated flap 28 results in the completion of the closure interlock 18 with both the primary locking tabs 22 and the secondary locking tab 27 being disposed inwardly of the carton 10 and secured in place.

At this time it is to be noted that when the secondary locking tab 27 passes through the outer closure panel 14, it engages the flap 24 and it displaces the same to permit the secondary locking tab 27 to move into position through the outer closure panel 14.

Although only a preferred embodiment of the closure interlock has been specifically illustrated and described herein, it is to be understood that minor variations may be made in the closure interlock without departing from the spirit and scope of the invention as defined by the appended claims.

I claim:

1. A closure interlock for a closure panel assembly of a carton of the wrap around type, said closure interlock comprising an inner closure panel and an outer closure panel each having a free edge, said inner closure panel having struck therefrom a secondary locking tab carried by a flap with said secondary locking tab facing said free edge of said inner closure panel, the displacement of said secondary locking tab and said flap from said inner closure panel defining an opening in said inner closure panel having as a boundary thereof a primary locking shoulder, and said outer closure panel having a terminal edge flap portion in part defined by a fold line and in part by cut line means, said cut line means defining a primary locking tab carried by said terminal edge flap portion and facing away from said outer closure panel free edge for locking behind said primary locking shoulder, said cut line means also defining a secondary locking shoulder facing away from said outer closure panel free edge for having received therebehind said secondary locking tab.

2. A closure interlock according to claim 1 wherein said primary locking tab and said secondary locking shoulder are in general alignment along the length of said interlock whereby a primary lock and a secondary lock are provided in general alignment thereby providing for a saving of carton stock.

3. A closure interlock according to claim 1 wherein said secondary locking tab extends first through said outer closure panel and then through said opening in said inner closure panel.

4. A closure interlock according to claim 3 wherein said secondary locking tab is joined to said secondary flap by a narrow neck portion, said narrow neck portion having an outline of which parts define two further secondary locking shoulders on said inner closure panel separate from said secondary locking tab adjacent said primary locking shoulder and facing away from said primary locking shoulder.

5. A closure interlock according to claim 4 wherein said secondary locking tab engages behind said two further secondary locking shoulders.

6. A closure interlock according to claim 4 wherein said secondary locking tab engages behind said two further secondary locking shoulders and is positioned within said opening.

7. A closure interlock according to claim 4 wherein said secondary locking tab engages behind said two further secondary locking shoulders and is positioned within that part of said opening from which it is formed.

8. A closure interlock according to claim 1 wherein there are two of said primary locking shoulders, one on each side of said secondary locking tab, and there are two of said primary locking tabs, one on each side of said secondary locking shoulder and interlocking behind respective ones of said primary locking shoulders.

9. A closure interlock according to claim 8 wherein said secondary locking shoulder is in alignment with said fold line.

10. A closure interlock according to claim 1 wherein said carton is constructed to package at least four items, and said secondary locking tab is positioned between the intended positions of said items.

11. A closure interlock for a closure panel assembly of a carton of the wrap around type, said closure interlock comprising an inner closure panel and an outer closure panel each having a free edge, said inner closure panel having struck therefrom a secondary locking tab carried by a secondary flap with said secondary locking tab facing said free edge of said inner closure panel, the displacement of said secondary locking tab and said secondary flap from said inner closure panel defining an opening in said inner closure panel having as a boundary thereof a primary locking shoulder, and said outer closure panel having a terminal edge flap portion in part defined by a fold line and in part by cut line means, said cut line means defining a primary locking tab carried by said terminal edge flap portion and facing away from said outer closure panel free edge and locking behind said primary locking shoulder, said secondary locking tab being connected to said secondary flap by a narrow neck portion, said narrow neck portion having an outline of which a part defines at least one secondary shoulder on said inner closure panel separate from said secondary locking tab and facing away from said primary locking shoulder.

12. A closure interlock according to claim 11 wherein said secondary locking tab engages behind said secondary locking shoulder.

13. A closure interlock according to claim 11 wherein said secondary locking tab has been returned into said opening and engages behind said secondary locking shoulder.

* * * * *